United States Patent [19]

Gottliebson

[11] 4,321,017

[45] Mar. 23, 1982

[54] PNEUMATIC EJECTOR CONTROL

[76] Inventor: Mayo Gottliebson, 419 E. Main St., Lancaster, Ohio 43130

[21] Appl. No.: 129,822

[22] Filed: Mar. 12, 1980

[51] Int. Cl.[3] ..... F04F 1/06

[52] U.S. Cl. ..... 417/128; 417/129; 417/134; 417/138; 417/146; 417/147

[58] Field of Search ..... 417/126, 128, 129, 131, 417/134, 138, 146, 147

[56] References Cited

U.S. PATENT DOCUMENTS 2,362,802 11/1944 Ciabattari ..... 417/128 X 3,161,144 12/1964 Hugentobler ..... 417/138

OTHER PUBLICATIONS

APCO Valve and Primer Corporation, Bulletin 666, APCO Sewage Air Valves, Model 400, Schaumburg, Ill.

*Primary Examiner*—Richard E. Gluck

*Attorney, Agent, or Firm*—Cushman, Darby & Cushman

[57] ABSTRACT

For starting and stopping air injection, a pneumatic ejector for a liquid transport system typified by a municipal sewerage system is provided with an air release valve fitted with a limit switch as a control device.

3 Claims, 3 Drawing Figures

PNEUMATIC EJECTOR CONTROL

BACKGROUND OF THE INVENTION

In diverse industrial, municipal and civil engineering works typified by municipal sewerage systems where fluids are being pumped against elevation and friction gradients, often centrifugal pumps are used. As an alternative, pneumatic ejectors sometimes are used. The function and desired result of such use is well-known: high pressure air is rapidly injected into a sealed pot which contains pumpable liquid, e.g. sewage. Increasing air pressure in the pot forces the pumpable liquid, e.g. sewage to leave the pot through an outlet check valve. There are several brands of such ejectors currently on the market, exemplified by the line of Shone (brand) SDV mechanically controlled pneumatic ejectors of Clow Corporation, Florence, Ky. 41042. Although the basic operation of such devices is simple and relatively trouble free, the valve devices used to start and stop the air injection have gained a reputation for being trouble prone.

SUMMARY OF THE INVENTION

For starting and stopping air injection, a pneumatic ejector for a liquid transport system typified by a municipal sewerage system is provided with an air release valve fitted with a limit switch as a control device.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing:

FIGS. 2A and 2B are diagrams showing alternate positions of the solenoid valve shown in FIG. 1.

DETAILED DESCRIPTION

Figure 1:
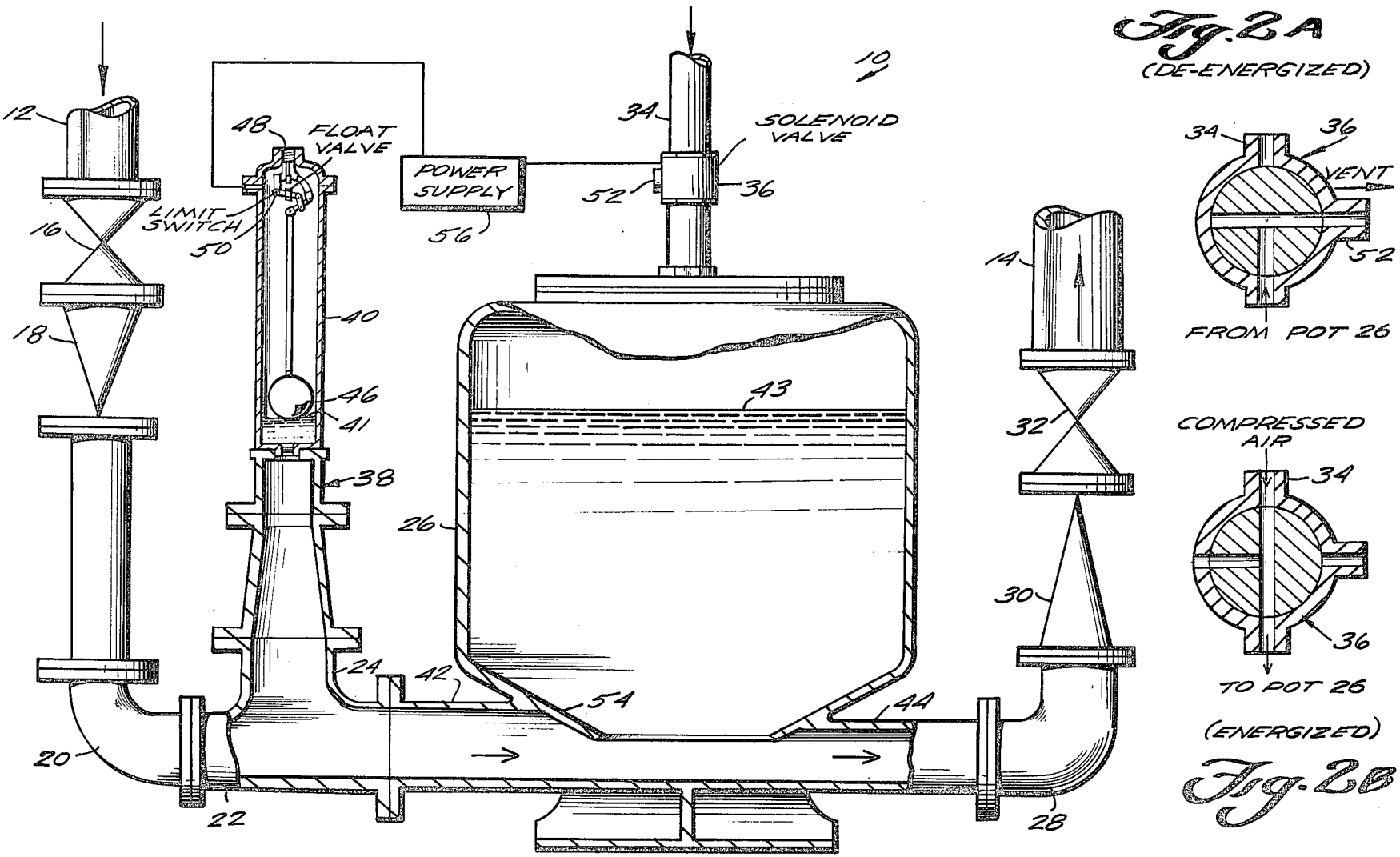
FIG. 1 is a fragmentary schematic elevational diagram of a liquid transport system, e.g. a sewerage system, having a pneumatic ejector provided with an air release valve fitted with a limit switch as a control device in accordance with principles of the present invention.

In use of the system 10 shown in FIG. 1, the objective is to forcibly transport fluid, e.g. sewage available at the inlet conduit 12 significantly downstream via the outlet conduit 14. To that purpose, the following items of equipment are depicted as interposed in the system 10 between the inlet conduit 12 and the outlet conduit 14: a plug valve 16, a ball check 18, an elbow 20, a tee 22 having a vertically upwardly projected center leg 24, a pneumatic ejector pot 26, an elbow 28, a conventional check valve 30 and a plug valve 32.

The air inlet line 34 to the pneumatic ejector pot 26 is shown having a three-way solenoid valve 36 (or equivalent) incorporated therein.

A control pipe 38 is mounted on the tee 22 center leg 24 and has an air release valve 40 mounted thereon. The spatial arrangement of the equipment preferably is as illustrated in FIG. 1 e.g. as a standpipe.

Typically, the valves 16, 18, 30 and 32 are four inch valves in four inch lines. Typically the ejector pot has a six inch inlet pipe 42 and a four inch outlet pipe 44 and the tee 22 has a four inch inlet leg and six inch outlet and center legs. The pneumatic ejector pot may be of a commercially available type. The air release valve 40 may also be of a commercially available type, such as the 400 APCO (brand) sewage air release valve of APCO Valve and Primer Corporation, Schaumberg, Ill. 60196.

The system shown in FIG. 1 has a filling stage, during which the solenoid valve is disposed as depicted in FIG. 2A, and an emptying stage during which the solenoid valve is disposed as depicted in FIG. 2B.

In the filling stage, the air release valve 40 is open and vents the top of the control pipe 38. During this stage the top of the pot 26 is vented through the remote control, e.g. solenoid valve 36 and thus the incoming sewage simultaneously fills the control pipe 38/air release valve 40 column and the pot 26 (which are comparable in height) with the liquid levels in each being constantly equal as they rise.

The air release valve 40 is equipped with a float 46 which rises on the rising liquid level in the control pipe 38/air release valve 40 column until, at its highest position 41 (equating to the pot 26 being full i.e. being filled to the predetermined level 43), the float 46 closes the valve vent 48 and actuates limit switch 50. In the instance depicted, the level 41 lies within the valve 40.

The limit switch 50, being actuated, energizes the coil of the solenoid valve 36, and thus switches the valve 26 from the position shown in FIG. 2A to the position shown in FIG. 2B. Accordingly, the pot vent 52 is closed and compressed air flows into the pot 26 through the air inlet line.

As the compressed air enters the pot, the sewage is ejected downstream via 44, 28, 30, 32 and 14, but the column in the control pipe 38/air release valve 40 cloumn remains filled to the level 41 because the vent 48 is closed and the compressed air has no way to get behind the liquid in the control pipe column. That situation changes when the liquid remaining in the pot 26 has fallen to the level 54. Then compressed air enters the control pipe column through 42, 22, letting the liquid level begin to fall in the control pipe column. As a result, the float 46 uncovers the vent 48 and releases the limit switch 50, which in turn deactivates the solenoid valve 36, returning it from the FIG. 2B position thereof to the FIG. 2A position thereof.

A cycle is thus completed, only to begin again, resulting in trouble-free automatic filling and emptying of the ejector pot 26.

The limit switch 50 and remotely operable valve 36 may be commercially available devices simply incorporated in circuit with a conventional power supply 56. Functionally equivalent automated devices may be used.

It should now be apparent that the pneumatic ejector control as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. In combination with a pneumatic ejector pot incorporates at its lower end a liquid transport conduit system between an upstream inlet conduit means incorporating and served by an upstream anti-backflow check valve, and a downstream outlet conduit means incorporating and served by a downstream anti-backflow check valve, and in which the ejector pot is served by a compressed air inlet line for connection with a compressed air supply for internally pressurizing the ejector pot to forcibly empty liquid therefrom downstream in said liquid transport conduit system, a control means for automatically selectively alternately supplying and terminating the supply of compressed air to the pot via said compressed air inlet line for cycling the pneumatic ejector pot between a filling phase thereof in which liquid runs into the ejector pot via the upstream inlet conduit and an emptying phase during which liquid which has filled the ejector pot to a predetermined level is forced out of the ejector pot and downstream through the downstream outlet conduit, said control means comprising:

a control standpipe based on said upstream inlet conduit means and having an internal chamber in communication with said inlet conduit means at the base of said control standpipe to provide a control column having a lower end corresponding with the lower end of the ejector pot and an upper end corresponding with said predetermined level, up to which the ejector pot is to become filled with liquid when it is to be considered as full;

a vent in said control standpipe above said upper end of said control column;

valve means for opening and closing said vent, said valve means including a liquid level sensing-type valve actuator for maintaining said valve means in a vent closing condition only when said control column is filled with liquid to a filling level corresponding to said predetermined level;

a remotely-operable valve incorporated in and serving said compressed air inlet line of said ejector pot;

said compressed air inlet line further including a pot vent; and said remotely operable valve being movable between one position, wherein the ejector pot is connected to said pot vent but disconnected from its compressed air supply and another position, wherein the ejector pot is disconnected from said pot vent but connected with said compressed air supply;

a limit switch operatively connected with said liquid level sensing-type valve actuator for providing a control signal equating with said control column being liquid-filled up to said filling level;

and operative connection means, including power means, connecting said limit switch with said remotely operable valve for placing said remotely operable valve in said other position only when said control column is filled up to said filling level thereof, so that, in operation:

the control column and ejector pot will fill with liquid together at equivalent levels until each is full respectively to said filling level and to said predetemined level, whereupon compressed air will eject the liquid from the ejector pot but not from the control column, until the ejector pot has been emptied sufficiently to open an airway via said inlet conduit means from the lower end of said ejector pot to the base of said control standpipe, whereupon the liquid level will fall in the control column causing its vent and the pot vent both to open again.

2. The apparatus of claim 1, wherein:

the remotely-operable valve in said compressed air line is a solenoid valve;

the liquid level sensing-type valve actuator is a valve actuating float also positioned to actuate said limit switch; and the operative connection means for said solenoid valve and said limit switch is an electrical circuit.

3. The apparatus of claim 1, wherein:

said liquid transport system is a sewerage system.

* * * * *